US009028293B2

(12) United States Patent
Smith et al.

(10) Patent No.: US 9,028,293 B2
(45) **Date of Patent: *May 12, 2015**

(54) DOLLHOUSE AND METHOD OF FOLDING THE DOLLHOUSE

(71) Applicant: TOMY International, Inc., Dyersville, IA (US)

(72) Inventors: Robin K. Smith, Long Beach, CA (US); Liliane Davidson, Studio City, CA (US)

(73) Assignee: TOMY International, Inc., Dyersville, IA (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/106,019

(22) Filed: Dec. 13, 2013

(65) Prior Publication Data

US 2014/0106645 A1 Apr. 17, 2014

Related U.S. Application Data

(62) Division of application No. 13/622,152, filed on Sep. 18, 2012, now Pat. No. 8,608,529, which is a division of application No. 12/210,412, filed on Sep. 15, 2008, now Pat. No. 8,303,369.

(60) Provisional application No. 60/972,113, filed on Sep. 13, 2007.

(51) Int. Cl.
*A63H 3/52* (2006.01)

(52) U.S. Cl.
CPC ..... *A63H 3/52* (2013.01)

(58) Field of Classification Search
USPC ..... 446/447
See application file for complete search history.

(56) References Cited

U.S. PATENT DOCUMENTS

| | | | | |
|---|---|---|---|---|
| 1,521,420 | A | 12/1924 | Beebe | |
| 1,801,724 | A | 4/1931 | Conklin | |
| 3,363,360 | A | 1/1968 | Ryan | |
| 3,719,001 | A | 3/1973 | Archer | |
| 4,067,137 | A | 1/1978 | Korthase | |
| 4,484,408 | A | 11/1984 | Fogarty et al. | |
| 4,508,519 | A | 4/1985 | Becker | |
| 4,883,443 | A | 11/1989 | Chase | |
| 5,004,445 | A | 4/1991 | Coleman et al. | |
| 5,435,769 | A | 7/1995 | Bertrand | |
| 6,190,174 | B1 * | 2/2001 | Lam | 434/169 |
| 6,227,931 | B1 * | 5/2001 | Shackelford | 446/268 |
| 6,443,796 | B1 | 9/2002 | Shackelford | |
| 6,460,851 | B1 | 10/2002 | Lee et al. | |
| 6,554,679 | B1 * | 4/2003 | Shackelford et al. | 446/268 |
| 6,937,152 | B2 | 8/2005 | Small | |

(Continued)

FOREIGN PATENT DOCUMENTS

| | | | |
|---|---|---|---|
| GB | 2 275 207 | A | 8/1994 |
| WO | WO-01/02072 | A1 | 1/2001 |

*Primary Examiner* — Tramar Harper
(74) *Attorney, Agent, or Firm* — Faegre Baker Daniels, LLP

(57) ABSTRACT

A dollhouse is moveable from a closed or folded position to an open or unfolded position. In its open configuration, the dollhouse provides one or more play areas on each side of the dollhouse. The dollhouse can be provided with a variety of sensors for detecting play activities and providing feedback such as audible feedback, motion or lights in response to the specific play activities. Feedback can also be produced in response to the order in which the sensors are activated and in response to activation by particular play components to encourage desired play behavior.

6 Claims, 9 Drawing Sheets

(56) References Cited

U.S. PATENT DOCUMENTS

| | | | | |
|---|---|---|---|---|
| 7,059,934 | B2 | 6/2006 | Whitehead | |
| 7,371,148 | B2 | 5/2008 | Marine et al. | |
| 8,062,089 | B2 * | 11/2011 | Hardin et al. | 446/175 |
| 2003/0236052 | A1 | 12/2003 | Brauer | |
| 2007/0224912 | A1 | 9/2007 | Hughes et al. | |

* cited by examiner

DOLLHOUSE AND METHOD OF FOLDING THE DOLLHOUSE

This Divisional application claims priority from U.S. application Ser. No. 13/622,152, filed on Sep. 18, 2012 (now U.S. Pat. No. 8,608,529), which in turn claimed priority from U.S. application Ser. No. 12/210,412 (now U.S. Pat. No. 8,303,369), filed on Sep. 15, 2008, which in turn claimed priority from U.S. Provisional Application No. 60/972,113 filed Sep. 13, 2007, the complete disclosures of which are hereby expressly incorporated by reference.

BACKGROUND AND SUMMARY OF THE INVENTION

The present invention relates to children's toys and, in particular, to a dollhouse.

Children's toys can take up valuable space in the house and to accommodate all of the child's toys sometimes requires additional storage facilities. Many parents understandably prefer toys that don't take up much space or are configurable into a smaller size while not being used.

The present invention includes a foldable dollhouse and a method of folding and unfolding the dollhouse. The dollhouse can be unfolded to provide a plurality of rooms of play and play space on both sides for multiple children to play. The dollhouse is also highly interactive with the child and responds to the child's play with action, sound and/or light features, enhancing the entertainment value to a child. The house also recognizes where in the house and in what order the child plays, changing its response to the child accordingly. The configuration of the dollhouse provides an expanded play area for one or more users because the dollhouse unfolds without additional assembly to provide access to both sides of the dollhouse at the same time. The configuration also allows the dollhouse to be folded to take up less space for storage purposes. The dollhouse also includes motion, sound, and light features.

In one embodiment of the present invention, a dollhouse includes a first sensor, a second sensor and means for providing different feedback to the user in response to the order in which the first and second sensors are activated by the user. The means for providing feedback can include a speaker, a light and/or a moveable component. The means for providing feedback may provide positive feedback when the user activates the first sensor and subsequently activates the second sensor and corrective feedback when the user activates the second sensor and subsequently activates the first sensor. The means for providing feedback may include a microprocessor. In certain embodiments, the dollhouse includes a memory device and/or a transceiver for establishing a wireless connection to a network. The dollhouse may include play pieces for activating at least one of the sensors.

In another embodiment of the invention, a dollhouse includes a first play piece, a second play piece and a sensor that is activated when the first play piece is adjacent to the sensor and is not activated when the second play piece is adjacent to the sensor.

In another embodiment of the invention, a dollhouse includes a first play piece, a second play piece, a sensor and means for providing a first feedback to the user when the first play piece is adjacent the sensor and a second feedback when the second play piece is adjacent the sensor. The means for providing feedback may provide positive feedback when the user positions the first play piece adjacent the sensor and provide corrective feedback when the user positions the second play piece adjacent the sensor.

In another embodiment of the invention, a dollhouse includes a first section, a second section and a third section. The first and second sections each have an exterior wall and at least one interior room. The third section has a first side having at least one room and a second side having at least one room. The third section is enclosed between the first and second sections when the dollhouse is in a folded or closed position. When the dollhouse is opened for play, the first side of the third section faces the same direction as the interior room of the first section and the second side of the third section faces the same direction as the interior room of the second section.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first", "second", and "third" are used herein for purposes of description and are not intended to indicate or imply relative importance or significance.

Figure 1:
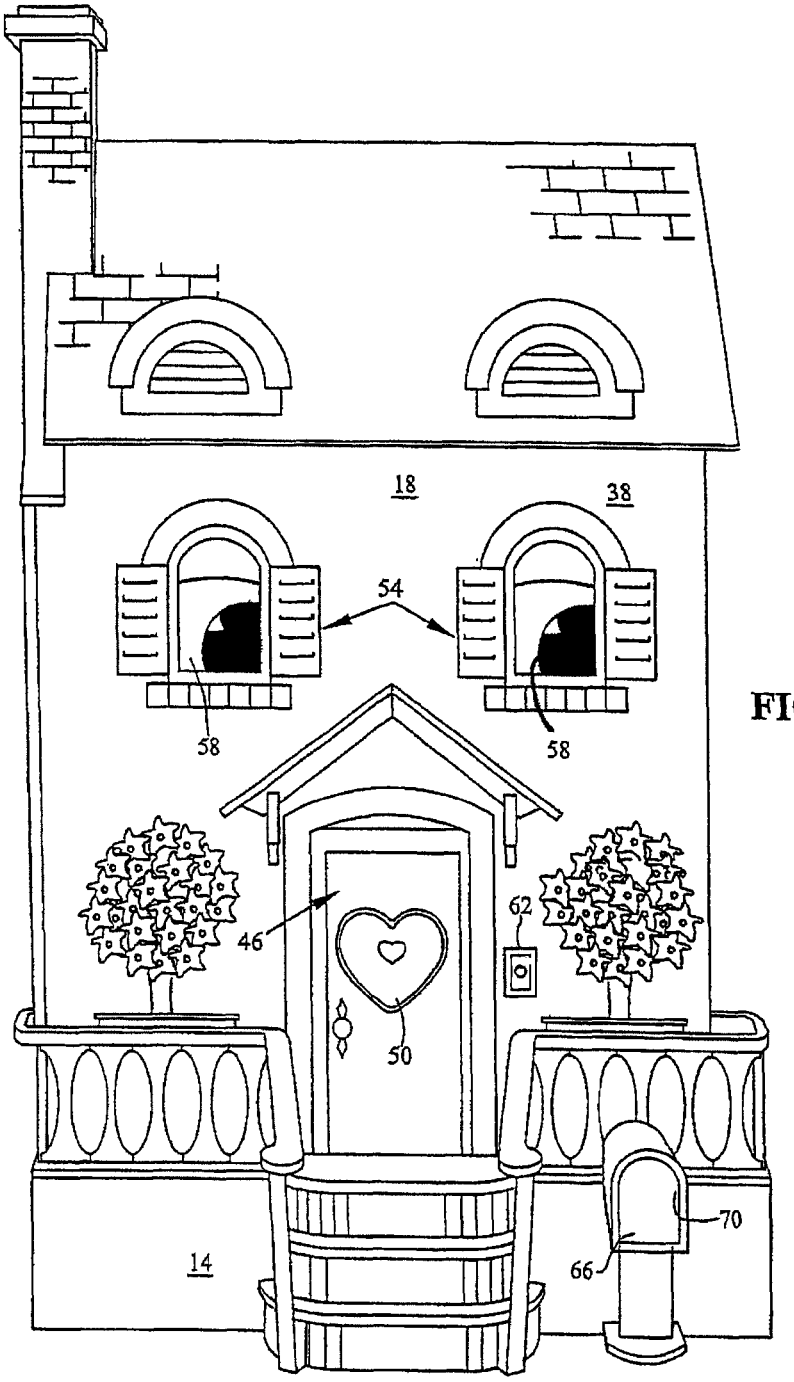
FIG. 1 is a front view of a dollhouse according to one embodiment of the present invention.
Figure 2:
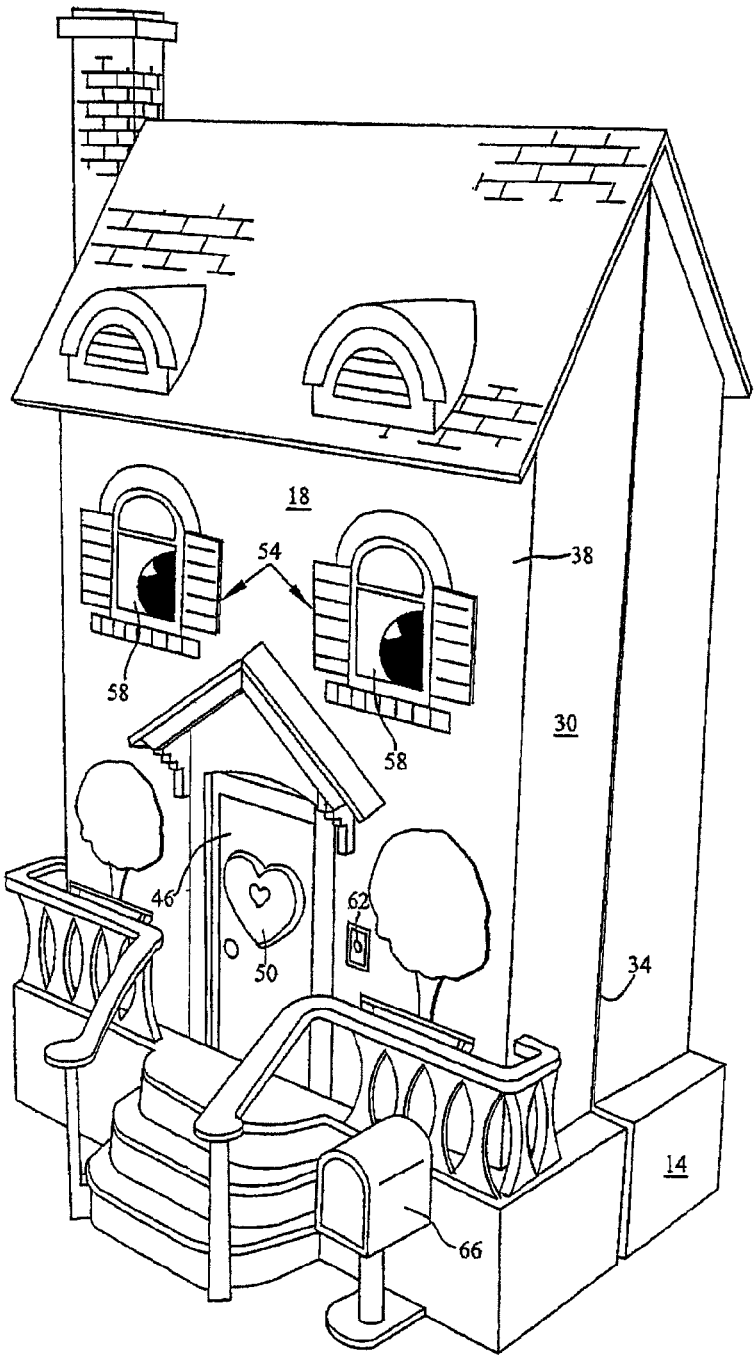
FIG. 2 is a perspective view of the dollhouse illustrated in FIG. 1.

FIGS. 1-2 illustrate a dollhouse 10 according to one embodiment of the present invention. The dollhouse 10 includes a base 14, which supports a front wall 18, a back wall 22, a left side wall 26, and a right side wall 30. The base 14, the front wall 18, the back wall 22, the left side wall 26, and the right side wall 30 define an enclosure 34. The front wall 18 includes an outside surface 38 (denoted in the Figures as "C") and an inside surface 42 (denoted in the Figures as "D;" FIG. 9).

The front wall 18 includes a front door 46 including an icon 50, such as a heart-shaped object. The front wall 18 also includes a plurality of windows 54 with each window 54 including a moveable panel 58 within the enclosure 34. The moveable panel 58 includes graphics that, in the embodiment shown, appear as eyes when the panel 58 is positioned such that the graphics appear within each window 54. The front wall 18 also includes a doorbell 62 generally positioned adjacent the door 46. The door 46 can open to provide access to the enclosure 34 upon activation of the doorbell 62. In addition, the activation of the doorbell 62 (or other suitable object) can initiate or activate the dollhouse 10. During activation of the dollhouse 10, the moveable panel 58 can move such that the graphics appear within the windows 54 indicating that the dollhouse 10 is "awake," for example. In addition, during activation, the dollhouse 10 can welcome or greet the user with one or more audible phrases.

The icon 50 on the door 46 is electronically controlled and is adapted to glow or illuminate. The icon 50 is adapted to change colors and intensity based on the play pattern of the user and/or the user's actions and interactions with the dollhouse 10. The icon 50 indicates how "happy" the dollhouse 10 is when the user plays nice and/or uses appropriate manners. The icon 50 changes color, for example, from blue when the dollhouse 10 is calm, to orange when it is getting happier, and to pink when it is the happiest. The child's interaction with the dollhouse 10 and the feedback from the dollhouse 10 is intended to promote desirable behaviors that parents generally like to see in their children. The interactivity of the dollhouse 10 is also intended to promote performance of good deeds and behavior modification in children. The dollhouse 10 playfully interacts with the user to inspire and reward positive social behaviors. The dollhouse 10 promotes positive family values through classic dollhouse play like sharing, caring for others, and being responsible. The dollhouse 10 senses the user's actions throughout the house with sensors (discussed below). The more positive behaviors the dollhouse 10 senses the happier the house gets with encouraging words and phrases, songs, and the glowing icon 50.

The dollhouse 10 also includes a mailbox 66 coupled to the front wall 18. The mailbox 66 includes a processor 70 having memory and software, such as a communications program, capable of communicating with a computer to download files from memory and/or the Internet. The mailbox 66 is removably coupled to the front wall 18 to connect wirelessly through a transceiver or via hardwire to a computer or network to download files including songs, phrases, stories, messages, etc. The files can include standard songs, phrases, stories, messages, etc. available to all users or the files can be personal and/or customized by a family member, friend or other person and made only available to a specific user. A family member or friend can create a file by typing in a word or phrase into the computer, e.g., "Time for dinner Emily! It's spaghetti, your favorite!" Each user is provided with a password to access a unique location or web site on the Internet for purposes of downloading the files. Upon completion of the download process, the mailbox 66 is connected wirelessly or via hardwire to the dollhouse 10. The files are transferred to a processor (discussed below) within the dollhouse 10 to provide additional play options.

Additional play pieces outside of the dollhouse 10 can also communicate wirelessly or via hardwire with the dollhouse 10 and/or a separate processor, such as a computer. For example, a garden outside of the dollhouse 10 can include one or more sensors that communicate with the dollhouse 10 and/or computer to promote good deeds based on the interaction between the sensor(s) and the child. As another example, a garage, vehicles, people, and animals can include one or more sensors to communicate with the dollhouse 10 and/or the computer to generate conversation, sounds, light, and other feedback to promote desirable behaviors in children.

Figure 3:
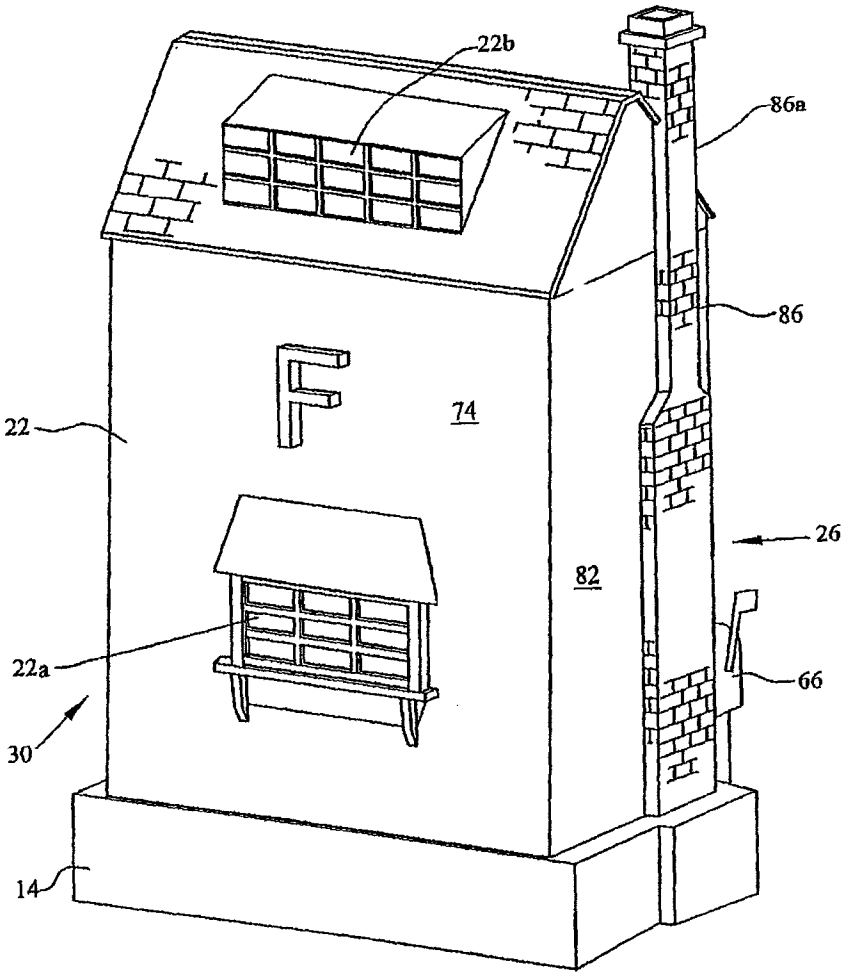
FIG. 3 is a rear perspective view of the dollhouse illustrated in FIG. 1.
Figure 5:
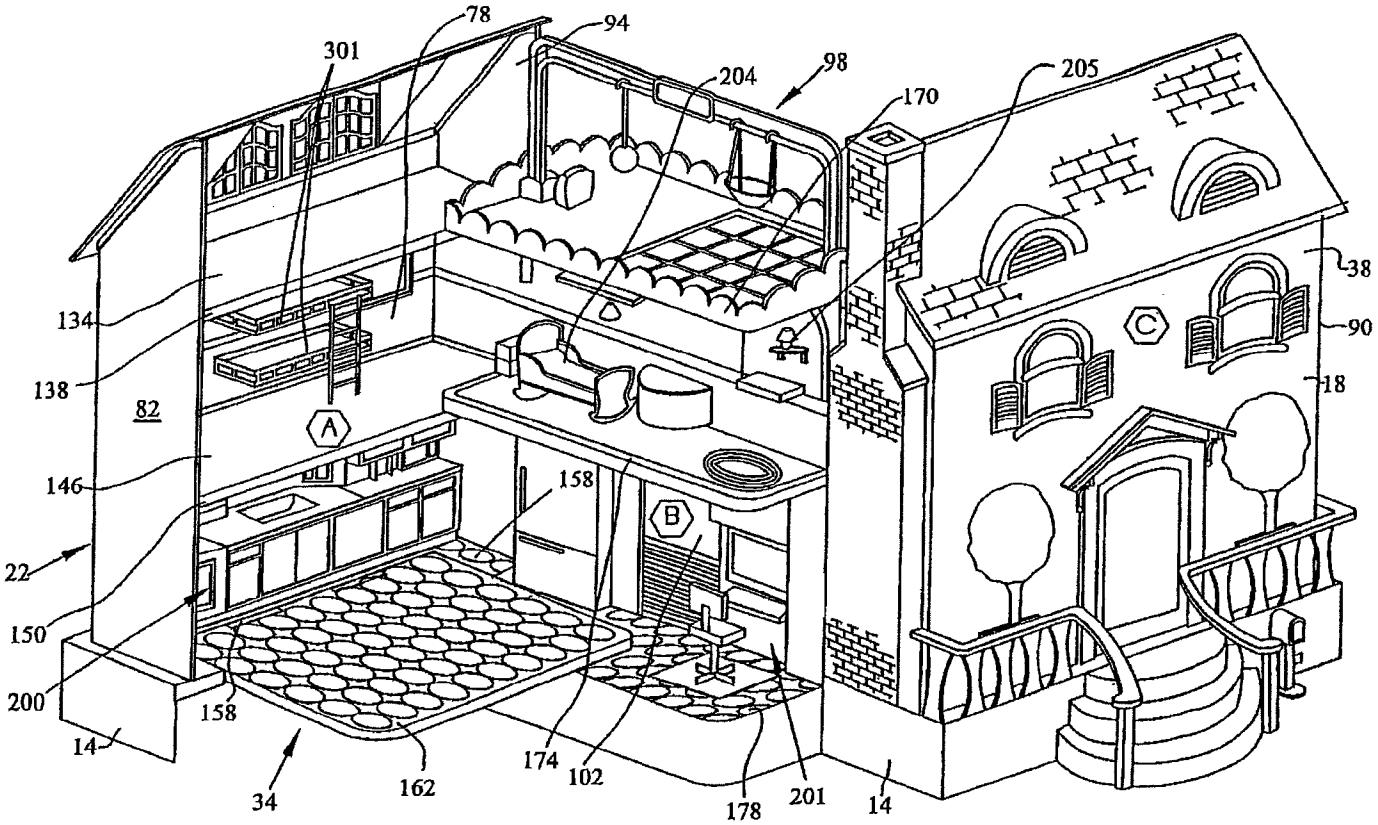
FIG. 5 is a perspective view of a first side of the dollhouse illustrated in FIG. 1 in an unfolded configuration.

The back wall 22 (FIG. 3) includes an outside surface 74 (denoted in the Figures as "F") and an inside surface 78 (denoted in the Figures as "A;" FIG. 5). The back wall 22 includes various features such as a window **22*a* in the wall and a window 22*b* extending from the roof. The left side wall 26 includes a first section 82 and a second section 86. The second section 86 of the left side wall 26 includes a chimney 86*a*. Similarly, the right side wall 30 includes a first section 90 and a second section 94. The features included on the front wall 18, the back wall 22, the left side wall 26, and the right side wall 30** may vary from the features illustrated in the Figures.

Figure 9:
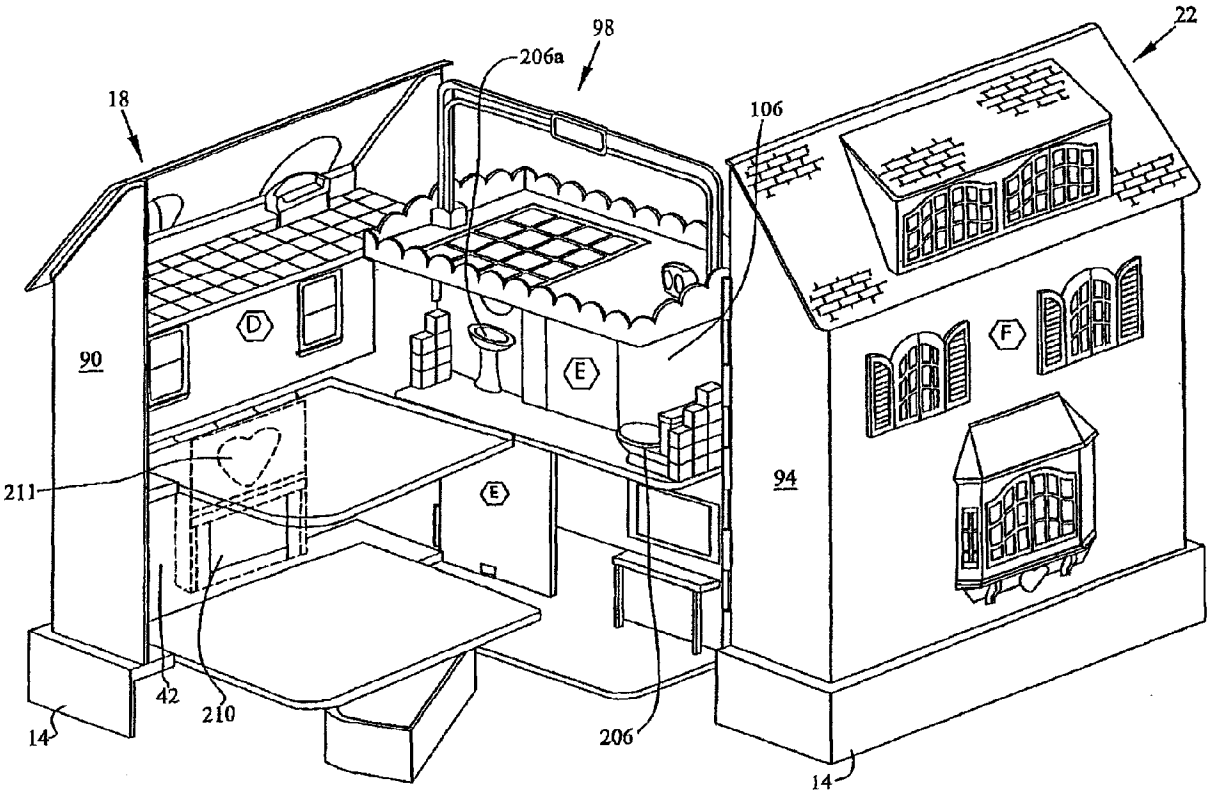
FIG. 9 is a perspective view of a second side of the dollhouse illustrated in FIG. 1 in an unfolded configuration.

FIGS. 1-4 illustrate the dollhouse 10 in a closed position. The closed position generally refers to a position where the front wall 18 is oriented generally parallel to the back wall 22. The dollhouse 10 is maneuverable to an open position as illustrated in FIGS. 5 and 9. The open position generally refers to a wide range of available configurations in which the front wall 18 is separated from the back wall 22 by an intermediate wall 98 (FIGS. 5-7 and 9). The intermediate wall 98 is positioned within the enclosure 34 when the dollhouse 10 is in the closed position.

The intermediate wall 98 includes a first surface 102 (denoted in the Figures as "B") and a second surface 106 (denoted in the Figures as "E"). The first surface 102 faces the inside surface 78 of the back wall 22 when the dollhouse 10 is in the closed position. The second surface 106 faces the inside surface 42 of the front wall 18 when the dollhouse 10 is in the closed position.

The intermediate wall 98 includes a left side edge 110, which is coupled to the second section 94 of the right side wall 30 via a first hinge 114. The first hinge 114 includes a vertical axis 118 and generally extends along a major portion of the length of the second section 94 and the intermediate wall 98. The first hinge 114 allows the back wall 22 and the intermediate wall 98 to pivot about the vertical axis 118 and move relative to one another.

The intermediate wall 98 also includes a right side edge 122, which is coupled to the second section 86 of the left side wall 26 via a second hinge 126. The second hinge 126 includes a vertical axis 130 and generally extends along a major portion of the length of the second section 86 and the intermediate wall 98. The second hinge 126 allows the front wall 18 and the intermediate wall 98 to pivot about the vertical axis 130 and move relative to one another. The first hinge 114 and the second hinge 126 allow the front wall 18 and the back wall 22 to move relative to one another as well. The hinges 114 and 126, although each is illustrated as a single hinge, can comprise a series of individual hinges positioned along their respective axes 118 and 130.

Figure 8:
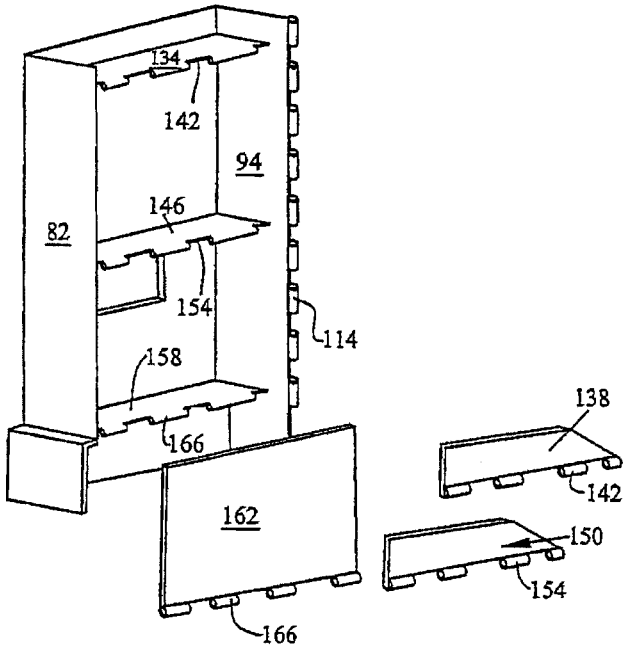
FIG. 8 is an exploded perspective view of a section of the dollhouse illustrated in FIG. 1.

With reference to FIG. 5, the inside surface 78 of the back wall 22 includes a first floor 134 at a first elevation and extending from and supported by the back wall 22, the first section 82 of the left side wall 26 and the second section 94 of the right side wall 30. In some embodiments, the first floor 134 is coupled to an extended floor 138 via a hinge 142 having a restricted range of motion (FIG. 8). For example, the hinge 142 can have a range of motion of about 180° such that the extended floor 138 is oriented in substantially the same plane as the first floor 134. This range of motion of the hinge 142 allows the extended floor 138 to rest upon the first floor 134 while not in use. The extended floor 138 is generally rectangular-shaped and can include a curved side as illustrated in FIG. 8. The curved side allows the extended floor 138 to be used while adjacent the intermediate wall 98 providing additional positions of the back wall 22 relative to the intermediate wall 98 while the dollhouse 10 is in an open position.

The inside surface 78 of the back wall 22 includes a second floor 146 at a second elevation and extending from and supported by the back wall 22, the first section 82 of the left side wall 26 and the second section 94 of the right side wall 30. In some embodiments, the second floor 146 is coupled to an extended floor 150 via a hinge 154 having a restricted range of motion. For example, the hinge 154 can have a range of motion of about 180° such that the extended floor 150 is oriented in substantially the same plane as the second floor 146. This range of motion of the hinge 154 allows the extended floor 150 to rest upon the second floor 146 while not in use. The extended floor 150 is generally rectangular-shaped and can include a curved side as illustrated in FIG. 8. The curved side allows the extended floor 150 to be used while adjacent the intermediate wall 98 providing additional positions of the back wall 22 relative to the intermediate wall 98 while the dollhouse 10 is in an open position.

The inside surface 78 of the back wall 22 includes a third floor 158 at a third elevation and extending from and supported by the back wall 22, the first section 82 of the left side wall 26 and the second section 94 of the right side wall 30. The third floor 158 is coupled to an extended floor 162 via a hinge 166 having a restricted range of motion. For example, the hinge 166 can have a range of motion of about 180° such that the extended floor 162 is oriented in substantially the same plane as the third floor 158. This range of motion of the hinge 166 allows the extended floor 162 to rest upon the third floor 158 while not in use.

The inside surface 78 of the back wall 22 and the floors 134, 146, and 158 (as well as similar features in the other section of dollhouse 10) can support additional play components such as kitchen appliances, bedroom furniture, bathroom furniture, etc. For example, in the embodiment show, dollhouse 10 includes a kitchen area including a stove 200 and a computer center 201, a nursery with a crib 204 and a light 205, a bathroom with a toilet 206, a sink **206*a*, a living room with a fire place 210 and heart light 211 and various other features. Various other play pieces can be used as desired. The first section 82 of the left side wall 26 can support a bracket for a play elevator to move dolls to the various floors 134, 146, and 158**.

The inside surface 42 of the front wall 18, illustrated in FIG. 9, is configured and oriented in a similar fashion as the inside surface 78 of the back wall 18 described above, and therefore will not be further described herein.

Figure 6:
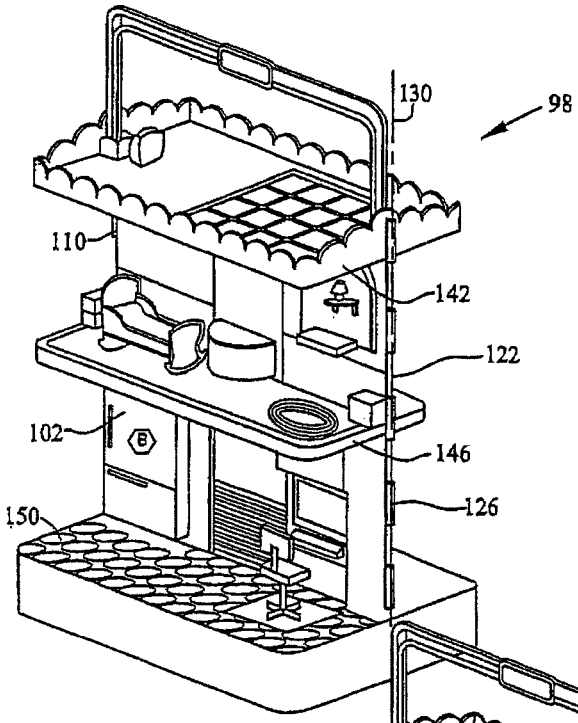
FIG. 6 is a perspective view of one side of a section of the dollhouse illustrated in FIG. 1.
Figure 7:
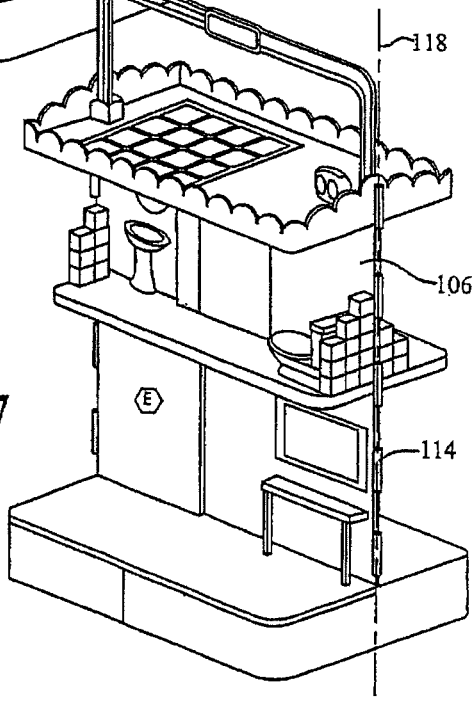
FIG. 7 is a perspective view of another side of the dollhouse section illustrated in FIG. 6.

With reference to FIGS. 5-7, the first surface 102 of the intermediate wall 98 includes a first floor 170 at a first elevation generally greater than the elevation of the first floor 134. The elevation of the first floor 142 of the intermediate wall 98 is oriented to be at a higher elevation such that the first floor 142 is positioned above the first floor 134 of the back wall 22 when the dollhouse 10 is moved to the closed position. The first floor 170 extends from and is supported by the intermediate wall 98. The first floor 170 can include a raised edge to help keep the play components positioned on the first floor 170.

The first surface 102 of the intermediate wall 98 also includes a second floor 174 at a second elevation generally greater than the elevation of the second floor 146. The elevation of the second floor 174 of the intermediate wall 98 is oriented to be at a higher elevation such that the second floor 174 is positioned above the second floor 146 of the back wall 22 when the dollhouse 10 is moved to the closed position. The second floor 174 extends from and is supported by the intermediate wall 98. The second floor 174 can include a raised edge to help keep the play components positioned on the second floor 174.

The first surface 102 of the intermediate wall 98 also includes a third floor 178 at a third elevation generally the same as the elevation of the third floor 158. The third floor 178 extends from and is supported by the intermediate wall 98. The third floor 178 can include a raised edge to help keep the play components positioned on the third floor 178.

The second surface 106 of the intermediate wall 98 illustrated in FIGS. 7 and 9 is configured and oriented in a similar fashion as the first surface 102 of the intermediate wall 98 described above, and therefore will not be further described herein.

Figure 4:
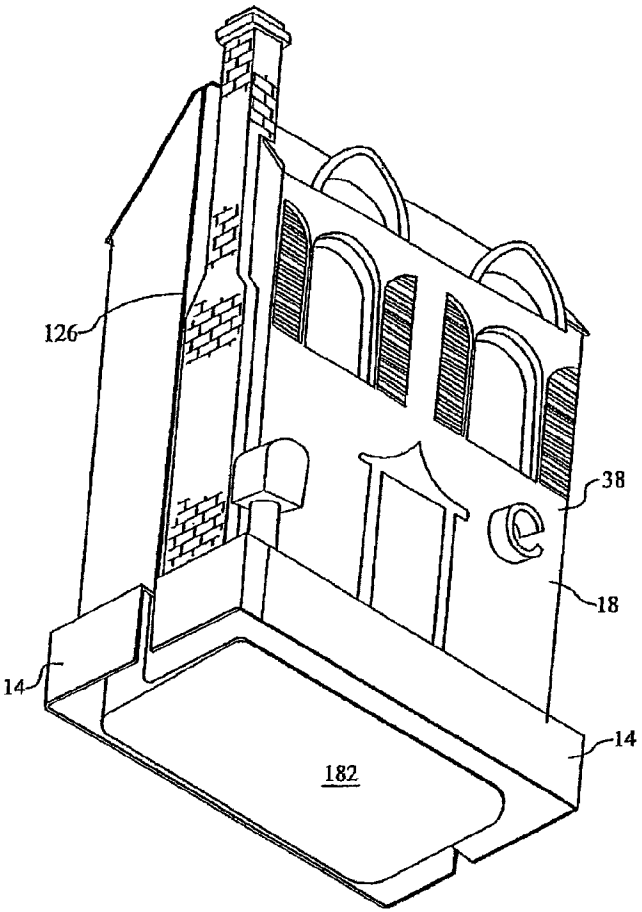
FIG. 4 is a bottom perspective view of the dollhouse illustrated in FIG. 1.
Figure 10:
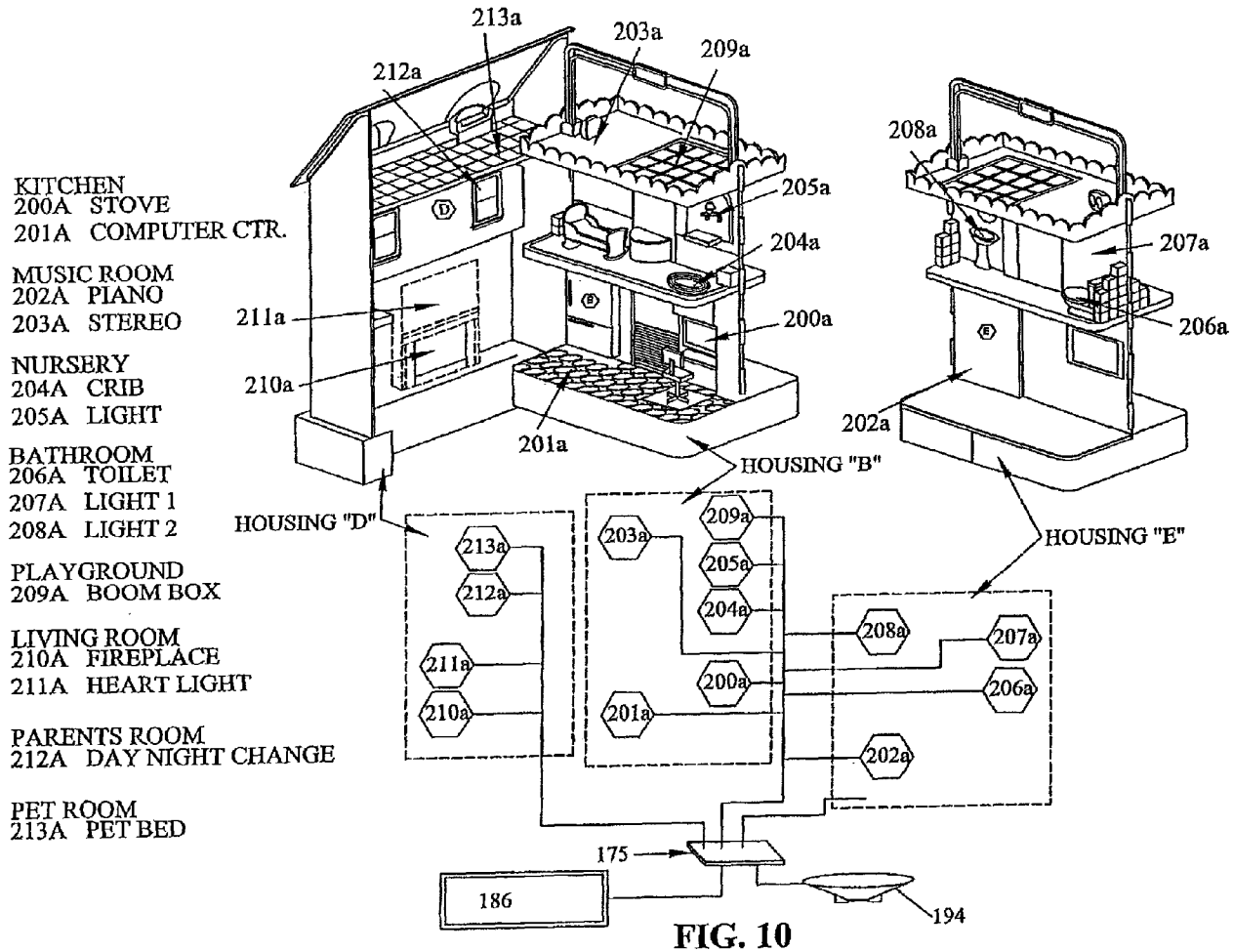
FIG. 10 is an electrical wiring schematic for the dollhouse illustrated in FIG. 1.

With reference to FIGS. 4 and 10, the dollhouse 10 includes a compartment 182 supported by the intermediate wall 98 and enclosed by the base 14 formed by the front wall 18 and the back wall 22 when in the closed position. The compartment 182 houses a processor 186, a power source (e.g., one or more batteries not shown), a speaker 194, and other suitable components, such as a printed circuit board 175 and/or a microprocessor (not shown), as needed. The processor 186 is electrically connected to various sensors 200-213 positioned throughout the dollhouse 10 as schematically illustrated in FIG. 10 to provide electronic functionality to the dollhouse 10. For example, the sensors provide motion, sound, and light when a sensor detects a particular play component. The sensors are coupled to the walls of the dollhouse 10 and detect when a particular play component contacts and/or is adjacent to the sensor. The processor 186 of the dollhouse 10 can generate motion, sound, and/or light related to the detected play component. For example, as shown in FIG. 10, a sensor **204*a* is located in the nursery and associated with the crib component. Accordingly, when the child places the crib on or near sensor 204*a*, dollhouse 10 can produce a response, such as playing a lullaby through speaker 194. As the crib 204 is placed adjacent sensor 204*a*, the dollhouse 10 may produce a phrase, such as "time for bed." In another alternative embodiment, sensor 204*a* could be responsive to placement of a baby doll play piece in crib 204 to produce feedback from dollhouse 10**.

As another example, if the sensor **210*a* detects a Christmas tree play component, the generated message could be "I love Christmas. Let's sing Jingle Bells (music for Jingle Bells and lyrics continue)." In some embodiments, these messages are pre-programmed into the processor 186 and may only be unlocked when the appropriate play component is detected by a particular sensor. This methodology creates additional incentives for the user to collect more accessories to hear new "surprise" messages from the dollhouse 10. In certain embodiments of the invention, the sensors 200*a*-213*a* can be configured to provide positive feedback when the child engages in appropriate behavior and corrective feedback when the child does not. For example, if the child places a baby play figure in crib 204, dollhouse 10 can produce the message "Thank you for putting baby to sleep. That was very nice of you." If, however, the child places a puppy play piece in the crib 204, dollhouse 10 could produce the message "You shouldn't put the puppy in the crib. The puppy can hurt the baby. The puppy belongs on the floor." The sensors can also be configured to provide feedback based on the order in which they are activated. For example, if the user places a human play piece near the toilet and then near the sink, dollhouse 10 can generate the message "thank you for washing your hands." If, however, the human play piece is not placed near the sink within a preset time after placement near the toilet, dollhouse 10 can generate the message "please remember to wash your hands." As noted above, dollhouse 10 and the sensors can be configured to cause the icon 50 on door 46** to change colors in response to appropriate and inappropriate play behavior.

Although the invention has been described in detail, the same is for purposes of illustration only and should not be taken in any way as a limitation on the scope of the invention. As will be readily apparent to those skilled in the art, various other modifications and components are within the scope of the invention. For example, although certain examples of potential feedback in response potential play activities have been discussed, countless other potential sets of feedbacks can be produced by dollhouse 10 in response to countless play activities and sequences. Furthermore, additional play components can be included other than those specifically illustrated and described. Similarly, the house may include other features such as a handle for easy of carry and for a latching mechanism to secure dollhouse 10 in its folded or closed configuration. Furthermore, the sensors are not intended to be limited to any particular kind. Rather, the various sensors could be optical, magnetic or of another form. Dollhouse 10 could also include a USB port or similar connection for receiving a portable memory device to transfer additional songs, messages, etc. to dollhouse 10. Accordingly, the scope of the invention is to be limited only by the terms of the attached claims.

The invention claimed is:

1. A dollhouse, including:

a first play piece for use within the dollhouse;

a second play piece for use within the dollhouse; and first and second sensors within the dollhouse that are activated to provide different feedback based on the order of activation when the first play piece is placed by a user adjacent to the sensors, and at least one of the sensors is not activated when the second play piece is placed by the user adjacent to the at least one of the sensors, and wherein positive feedback is provided when the first sensor is activated before the second sensor and corrective feedback is provided when the second sensor is activated before the first sensor to inform the user what an appropriate sequence of activities related to correct activation would be.

2. The dollhouse according to claim 1, further including a speaker for providing audible feedback when the first play piece is adjacent to one of the sensors.

3. The dollhouse according to claim 1, further including a light for providing visual feedback when the first play piece is adjacent to one of the sensors.

4. The dollhouse according to claim 1, further including a moveable component coupled to the dollhouse for providing visual feedback when the first play piece is adjacent to one of the sensors.

5. The dollhouse according to claim 1, further including a port for connecting the do house to a memory device.

6. The dollhouse according to claim 1, further including a transceiver for establishing a wireless connection to a network.

* * * * *